US010060622B2

(12) United States Patent
Biagioli et al.

(10) Patent No.: US 10,060,622 B2
(45) Date of Patent: Aug. 28, 2018

(54) AXIAL SWIRLER

(71) Applicant: Ansaldo Energia Switzerland AG, Baden (CH)

(72) Inventors: Fernando Biagioli, Fislisbach (CH); Madhavan Narasimhan Poyyapakkam, Rotkreuz (CH); Stefan Wysocki, Zürich (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 316 days.

(21) Appl. No.: 14/793,775

(22) Filed: Jul. 8, 2015

(65) Prior Publication Data

US 2016/0010856 A1 Jan. 14, 2016

(30) Foreign Application Priority Data

Jul. 10, 2014 (EP) ..... 14176546

(51) Int. Cl.
*F23D 14/02* (2006.01)
*F23R 3/14* (2006.01)
*F23D 14/24* (2006.01)

(52) U.S. Cl.
CPC ..... *F23D 14/02* (2013.01); *F23D 14/24* (2013.01); *F23R 3/14* (2013.01); *F23C 2900/07001* (2013.01)

(58) Field of Classification Search
CPC ..... F23D 14/24; F23D 11/383; F23R 3/14; F23C 2900/07001; F01D 5/141;
(Continued)

(56) References Cited

U.S. PATENT DOCUMENTS

2010/0170255 A1* 7/2010 Zuo ..... F23R 3/14 60/748
2012/0285173 A1* 11/2012 Poyyapakkam ..... F23C 7/004 60/772

FOREIGN PATENT DOCUMENTS

EP 1 394 471 A1 3/2004
EP 2 522 912 A1 11/2012
(Continued)

*Primary Examiner* — William H Rodriguez
*Assistant Examiner* — William Breazeal
(74) *Attorney, Agent, or Firm* — Buchanan Ingersoll & Rooney PC

(57) ABSTRACT

The present invention relates to an axial swirler, in particular for premixing of oxidizer and fuel in gas turbines. The axial swirler for a gas turbine burner includes a plurality of swirl vanes with a streamline cross-section being arranged around a swirler axis and extending in radial direction between an inner radius $R_{min}$ and an outer radius $R_{max}$. Each swirl vane has a leading edge, a trailing edge, and a suction side and a pressure side extending each between the leading and trailing edges. A discharge flow angle $\alpha$ between a tangent to the swirl vane camber line at its trailing edge and the swirler axis is first function of radial distance R from the swirler axis. A position of maximum camber of the swirl vane is second function of radial distance R from the swirler axis. At least one swirl vane of the first and second functions include each a respective local maximum and local minimum values along said radial distance from $R_{min}$ to $R_{max}$. The invention also relates to a burner with such a swirler.

20 Claims, 12 Drawing Sheets

(58) Field of Classification Search
CPC . F01D 5/142; F01D 5/145; F01D 5/46; F01D 9/023
See application file for complete search history.

(56) References Cited

FOREIGN PATENT DOCUMENTS

| | | |
|---|---|---|
| EP | 2 685 164 A1 | 1/2014 |
| WO | 03/102407 | 12/2003 |

* cited by examiner

AXIAL SWIRLER

CROSS-REFERENCE TO RELATED APPLICATIONS

This application claims priority to European Patent Application No. 14176546.1 filed Jul. 10, 2014, the contents of which are hereby incorporated in its entirety.

FIELD OF THE INVENTION

The present invention relates to an axial swirler, in particular for premixing purposes in gas turbines, and it relates further to a burner for a combustion chamber with such an axial swirler. In particular it relates to axial swirlers for the introduction of at least one gaseous and/or liquid into a burner.

BACKGROUND

Swirlers are used as mixing devices in various technical applications. Optimization of swirlers aims at reducing the energy required to obtain a specified degree of homogeneity of a mixture. In continuous flow mixing the pressure drop over a mixing device is a measure for the required energy. Further, the time and space required to obtain the specified degree of homogeneity are important parameters for the evaluation of mixing devices or mixing elements. Swirlers are typically used for mixing of two or more continuous fluid streams. Axial swirlers are most commonly used as premixers in gas turbine combustors. A so-called swirl number $s_n$ characterizes the swirl strength of an axial swirler. The swirl number is defined as the ratio between the axial flux of azimuthal momentum and the axial flux of axial momentum multiplied by the swirler radius. The swirl number is an indication of the intensity of swirl in the annular flow induced by the swirler.

Swirl burners are devices that, by imparting sufficiently strong swirl to an air flow, lead to the formation of a central reverse flow region (CRZ) due to the vortex breakdown mechanism which can be used for the stabilization of flames in gas turbine combustors.

Targeting best fuel-air premixing and low pressure drop is often a challenge for this kind of devices. Good fuel-air premixing must be in fact achieved in a mixing region before the CRZ where the flame is stabilized. This implies the need in this mixing region of sufficiently high pressure losses, i.e. the use of a swirler with sufficiently high swirl number which allows the tangential shearing necessary to well premix fuel with air. High swirl number flows however give also origin to strong shearing at CRZ with too large and unnecessary pressure losses just in this region.

An improvement to the standard design of axial swirl burner has been proposed in U.S. 2012/0285173. This improvement consists in the introduction of a lobed trailing edge which can create small scale counter-rotating vortices embedded into the main vortex and able to enhance fuel-air mixing without significant effect on the swirl number of the main vortex. This solution, which has its origin in the application of lobes to non-swirling devices (disclosed in EP 2 522 912), allows to achieve improved fuel-air mixing also at low swirl numbers of the main swirling flow, with a benefit on pressure losses at the CRZ.

The use of these existing design concepts (standard and lobed swirlers) carries however several risks and disadvantages. In case of the lobed axial swirler, the main risk is flow separation at the trailing edge due to change in the exit flow angle taking place too late along the chord of the swirler. A second deficiency is given by the formation of rotating secondary flow structures in the swirler vanes which, carrying the fuel around, make rather challenging the control and optimization of fuel spatial distribution (spatial unmixedness). In addition, the strong distortion along the trailing edge given by the lobed structure represents, on its own, a major manufacturing difficulty.

For all these reasons, there is a need for the new swirlers that could allow reduced pressure drop, robust flashback characteristics and improved $NO_x$ (due to better mixing), but also keep design relatively simple.

SUMMARY OF THE INVENTION

It is an object of the present invention to provide a highly effective swirler with a low pressure drop. As an application of such a swirler a burner comprising such a swirler is disclosed.

The above and other objects are achieved by an axial swirler for a gas turbine burner, comprising a plurality of swirl vanes with a streamline cross-section being arranged around a swirler axis and extending in radial direction between an inner radius ($R_{min}$) and an outer radius ($R_{max}$). The minimum radial distance $R_{min}$ is the distance from the swirler axis to the inner side or the inner lateral surface of the swirl vane. The maximum radial distance $R_{max}$ is the distance from the swirler axis to the outer side or the outer lateral surface of the swirl vane. Each swirl vane has a leading edge, a trailing edge, and a suction side and a pressure side extending each between said leading and trailing edges. Discharge flow angle ($\alpha$) between a tangent to the swirl vane camber line at its trailing edge and the swirler axis is first function of radial distance (R) from the swirler axis, and a position of maximum camber of the swirl vane is second function of radial distance (R) from the swirler axis. At least for one swirl vane said first and second functions comprise each a respective local maximum and local minimum values along said radial distance from $R_{min}$ to $R_{max}$. According to one embodiment, said first function of radial distance (R) from the swirler axis, and/or said second function of radial distance (R) from the swirler axis are periodic functions. A period of the said first function of radial distance (R) from the swirler axis, or/and said second function of radial distance (R) from the swirler axis is from 1 to 100 mm, preferably in the range 20-60 mm.

According to one embodiment, said first function of radial distance (R) from the swirler axis, and/or said second function of radial distance (R) from the swirler axis are sinusoidal functions.

According to another embodiment, said first function of radial distance (R) from the swirler axis, and/or said second function of radial distance (R) from the swirler axis are triangular or rectangular functions.

According to one embodiment, said first function of radial distance (R) from the swirler axis, and/or said second function of radial distance (R) from the swirler axis are the same function type. For example, they can both be sinusoidal.

According to yet another embodiment said first function of radial distance (R) from the swirler axis, and said second function of radial distance (R) from the swirler axis are substantially in phase along radial distance from $R_{min}$ to $R_{max}$.

According to one embodiment, the first periodic function of radial distance (R) from the swirler axis is given by a function:

$$\alpha_0+R^b\alpha^*\sin(2\pi NR)$$

where $\alpha_0$ is fixed angle, $\alpha^*$ is maximum angle deviation, b and N are rational numbers.

According to another embodiment all the swirl vanes are identically formed and/or all the swirl vanes are arranged around the swirler axis in a circle.

According to yet another embodiment, the said first function of radial distance (R) from the swirler axis of two adjacent vanes are in phase or are out of phase inverted. If applied to a burner, the swirler as described above leads to a good mixing at low pressure drop but also to a high recirculation flow in a subsequent combustor.

The burner comprising an axial swirler as described above is characterized in that at least one of the swirl vanes is configured as an injection device with at least one fuel nozzle for introducing at least one fuel into the burner.

The burner can comprise one swirler or a plurality of swirlers. A burner with one swirler typically has a circular cross section. A burner comprising a plurality of swirlers can have any cross-section but is typically circular or rectangular. Typically a plurality of burners is arranged coaxially around the axis of a gas turbine. The burner cross-section is defined by a limiting wall, which for example forms a can-like burner.

In one embodiment the burner under full load injects fuel from the suction side or the pressure side of at least one, preferable of all swirl vanes.

In a particularly preferred embodiment, the fuel is injected on the suction side and the pressure side of each swirler vane, i.e. from both sides of the injecting swirl vane simultaneously.

Preferably the axial swirler and/or the burner described above is used in an annular combustor, a can combustors, or a single or reheat engines.

Further embodiments of the invention are laid down in the dependent claims.

BRIEF DESCRIPTION OF DRAWINGS

Preferred embodiments of the invention are described in the following with reference to the drawings, which are for the purpose of illustrating the present preferred embodiments of the invention and not for the purpose of limiting the same. In the drawings.

DETAILED DESCRIPTION OF THE DRAWINGS

Figure 1:
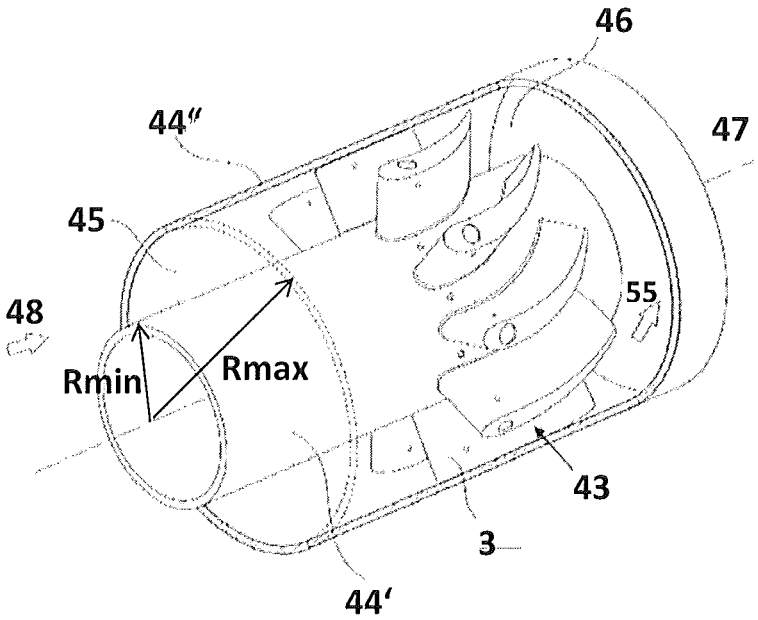
FIG. 1 shows a schematic perspective view onto a conventional swirler with swirl vanes having trailing edges with conventional discharge flow angles $\alpha(R)$=const.

FIG. 1 shows a schematic perspective view onto a conventional swirler 43. The swirler 43 comprises an annular housing with an inner limiting wall 44', an outer limiting wall 44", an inlet area 45, and an outlet area 46. Vanes 3 are arranged between the inner limiting wall 44' and outer limiting wall 44". The swirl vanes 3 are provided with a discharge flow angle that does not depend on a distance R from a swirl axis 47, but is constant throughout the annulus. The leading edge area of each vane 3 has a profile, which is oriented parallel to the inlet flow direction 48. The vanes are extending in radial direction between an inner radius ($R_{min}$) and an outer radius ($R_{max}$). In the example shown the inflow is coaxial to the longitudinal axis 47 of the swirler 43. The profiles of the vanes 3 turn from the main flow direction 48 to impose a swirl on the flow, and resulting in an outlet-flow direction 55, which has an angle relative to the inlet flow direction 48. The main flow is coaxial to the annular swirler. The outlet flow is rotating around the axis 47 of the swirler 43.

For better understanding and appreciation of the embodiments of the present invention, first, design of standard and lobed axial swirler from prior art will be explained.

Design of a Standard Axial Swirler

We refer to a class of swirlers with exit flow angle (a) whose tangent is linearly increasing in radial direction from a minimum value $\alpha_{MIN}$ at the minimum radius $R_{min}$ to a maximum value $\alpha_{MAX}$ at the maximum radius $R_{MAX}$. The radius is normalized with its maximum value, hence $R_{MAX}=1$:

$$\tan[\alpha(R)]=K_1 R+K_2;\ \text{with } K1,K2 \text{ from } \alpha_{MIN} \text{ and } \alpha_{MAX}$$

Figure 2:
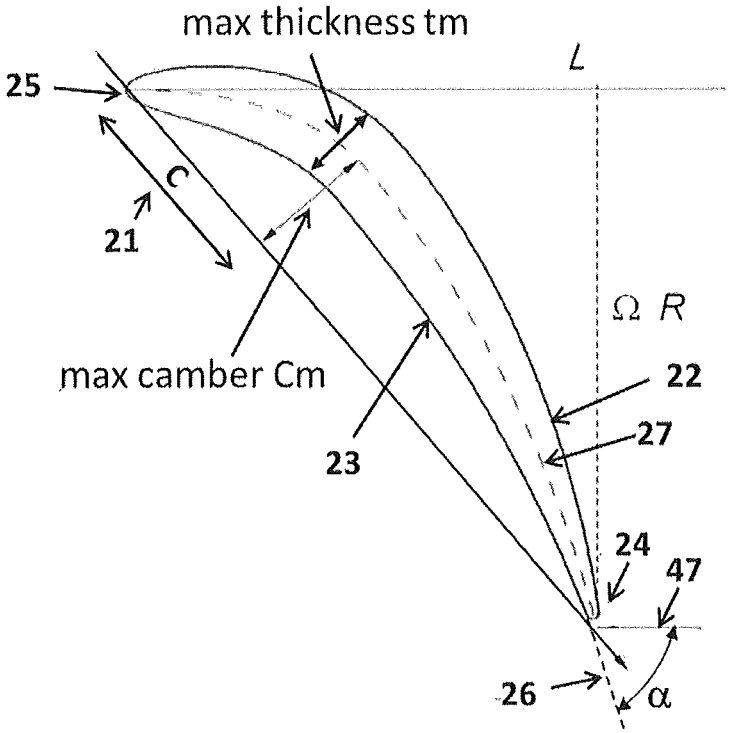
FIG. 2 shows cross section of swirler blade based on NACA4 airfoil.

The swirler blade 3 is characterized by a cross section at radius R defined by a given distribution of the camber line and of the blade thickness, for example, as given by NACA type airfoils as shown in FIG. 2. Swirl vane 3 has a leading edge 25, a trailing edge 24, and a suction side 22 and a pressure side 23 extending each between said leading and trailing edges (25, 24). The swirler blades are obtained requiring that the radial distribution of the tangent to the airfoil camber line at the trailing edge and the swirler axis is equal to the target exit flow angle distribution $\alpha(R)$.

An additional condition is given by the tangent to the camber line at the leading edge aligned with the swirler axis.

These two conditions determine a one-to-one relation between the distribution of Ω/L, the ratio between the azimuthal drop Ω from leading to trailing edge in a cylindrical coordinate system and swirler blade axial extension L, and the position of the maximum camber C at any given radius R.

Figure 3:
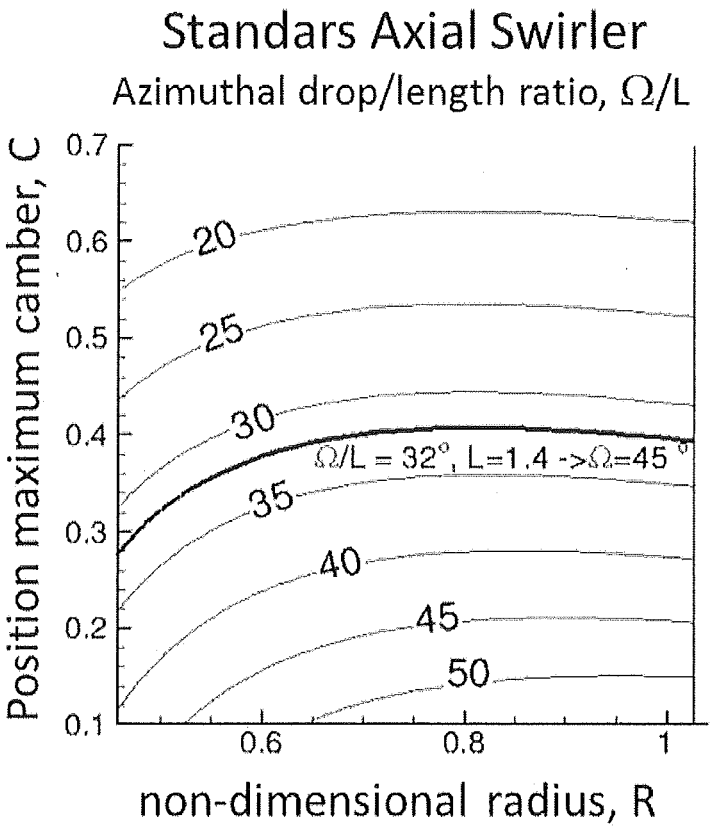
FIG. 3 shows distribution of $\Omega/L$ for a standard axial swirler with $\alpha_{MIN}=20°$, $\alpha_{MAX}=50°$.

FIG. 3 shows the distribution of this ratio for a swirler with $\alpha_{MIN}$=20°, $\alpha_{MAX}$=50° in terms of radius R and position of maximum camber C. Any path from $R=R_{min}$ to $R=R_{max}$ represents a swirler blade nominally delivering the target exit flow distribution. A swirler for example with L=cost=1.4 and Ω=45° is obtained taking the radial distribution of, almost constant and equal to 0.4, as given by the black line.

Figure 4:
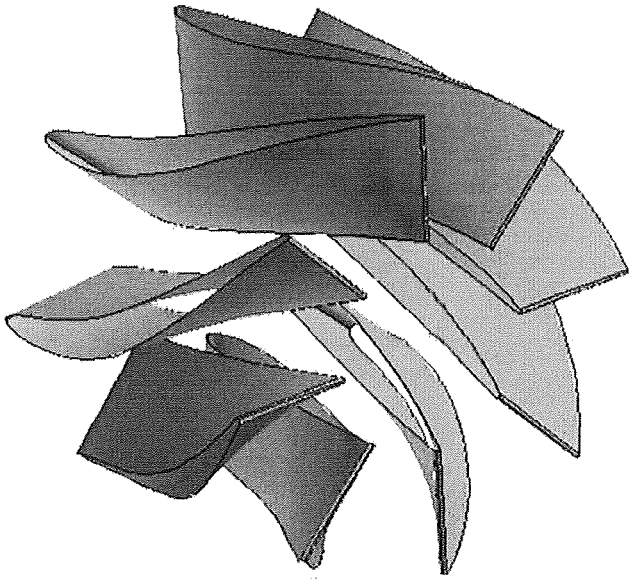
FIG. 4 shows schematic perspective view of eight blades standard axial swirler corresponding to L=1.4, $\Omega=45°$.
Figure 5:
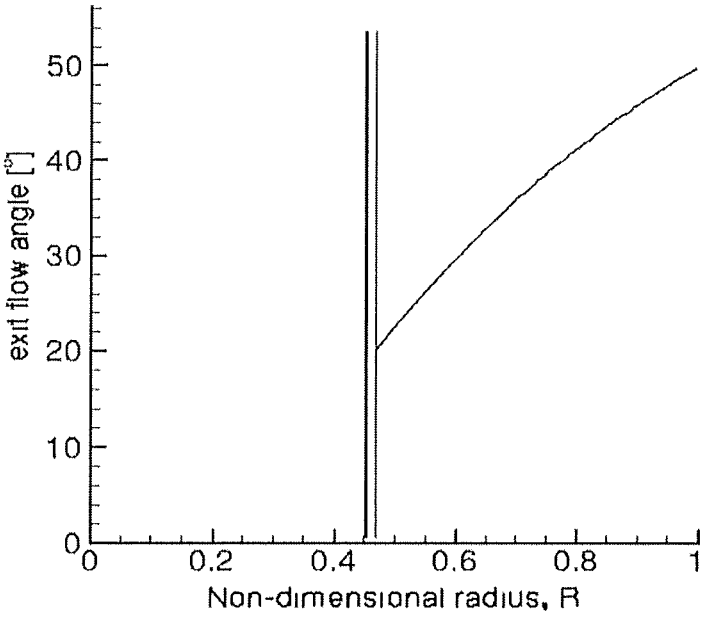
FIG. 5 shows radial distributions of exit flow angle of standard swirler corresponding to FIG. 3 and FIG. 4.

This swirler is shown on the FIG. 4, while exit flow angle as a function of non-dimensional radius R is shown in FIG. 5.

Design of Lobed Swirler

Figure 6:
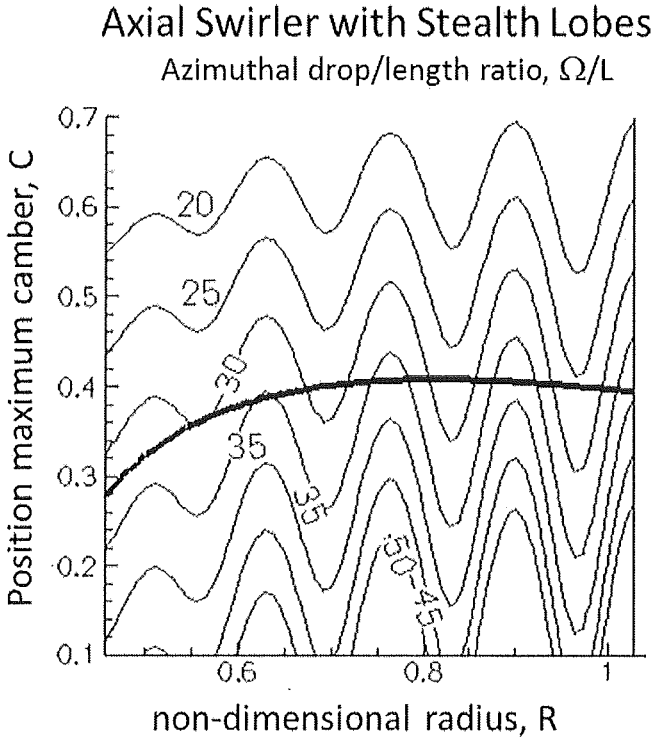
FIG. 6 shows distribution of $\Omega/L$ for a lobed axial swirler.

The axial lobed swirler is usually obtained by superimposing a periodic deviation in the exit flow angle to the main one characterizing the standard axial swirler. The swirler map corresponding to this design is shown in FIG. 6.

The deviation that is used here is given by:

$$\Delta\alpha(R)=R^b\alpha^*\sin(2\pi N_{lobes}R)$$

where α* is the maximum deviation, $N_{lobes}$ the number of lobes and where linear dependency from $R^b$ is introduced to modulate the maximum deviation from the minimum to the maximum radiuses. Value of b between 0.3 and 3 are considered.

Figure 7:
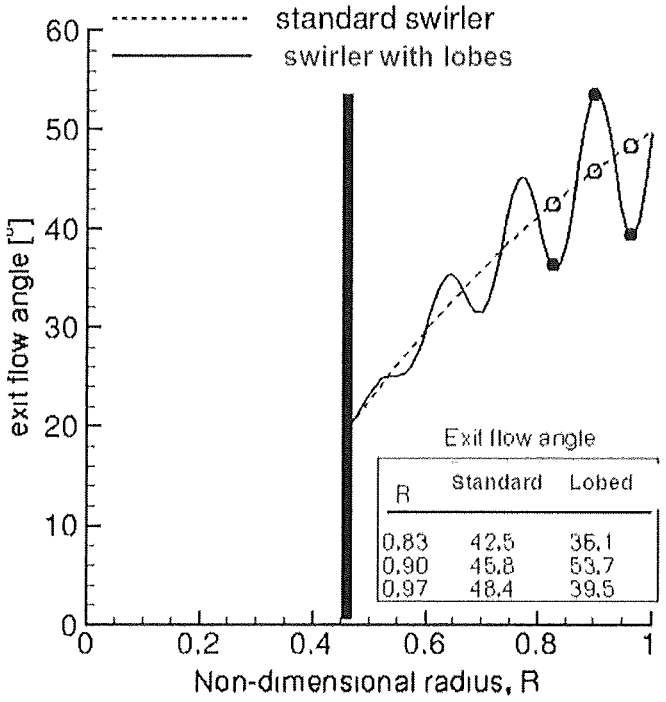
FIG. 7 shows radial distributions of the exit flow angle for standard and lobed swirler. The exit flow angle is given in table for three values of the radius.
Figure 8:
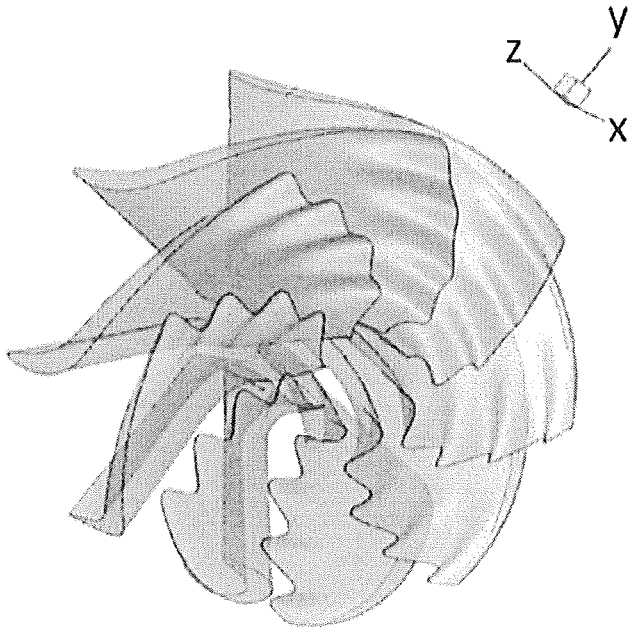
FIG. 8 shows schematic perspective view of lobed swirler according to prior art

The design of such a swirler is achieved, by introducing this fluctuation more or less gradually along the airfoils (sometimes suddenly) starting from the position of the maximum camber of the standard axial swirler. Such a design concept leads to a swirler with a periodically lobed trailing edge as shown in FIG. 8 for a case with b=1 and α=10°. Exit flow angle as a function of non-dimensional radius R for lobed swirler is shown in FIG. 7.

Design of the Swirler According to Invention

The design criteria given in the previous section for the lobed axial swirler implies a periodic fluctuation of the azimuthal drop Ω of the trailing edge. The design according to the embodiments of the invention, proposed here, consists in avoiding this fluctuation of the trailing edge by compensating with a fluctuation in the position of maximum camber C.

Figure 9:
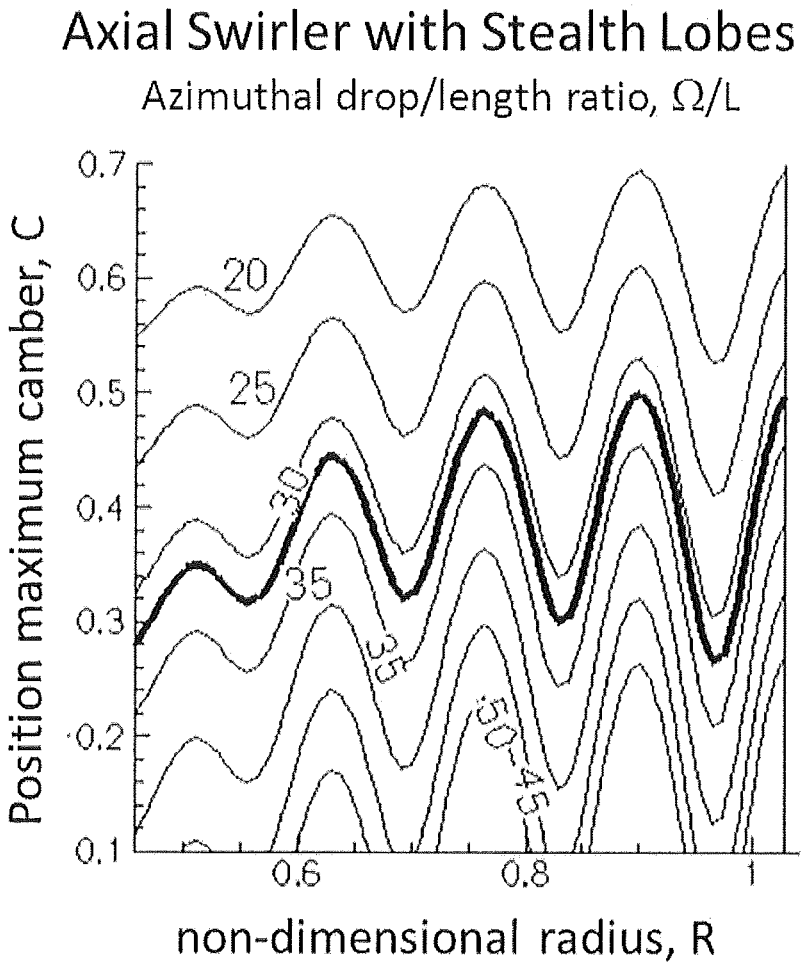
FIG. 9 shows distribution of $\Omega/L$ for an axial swirler according to embodiment of the invention.
Figure 10:
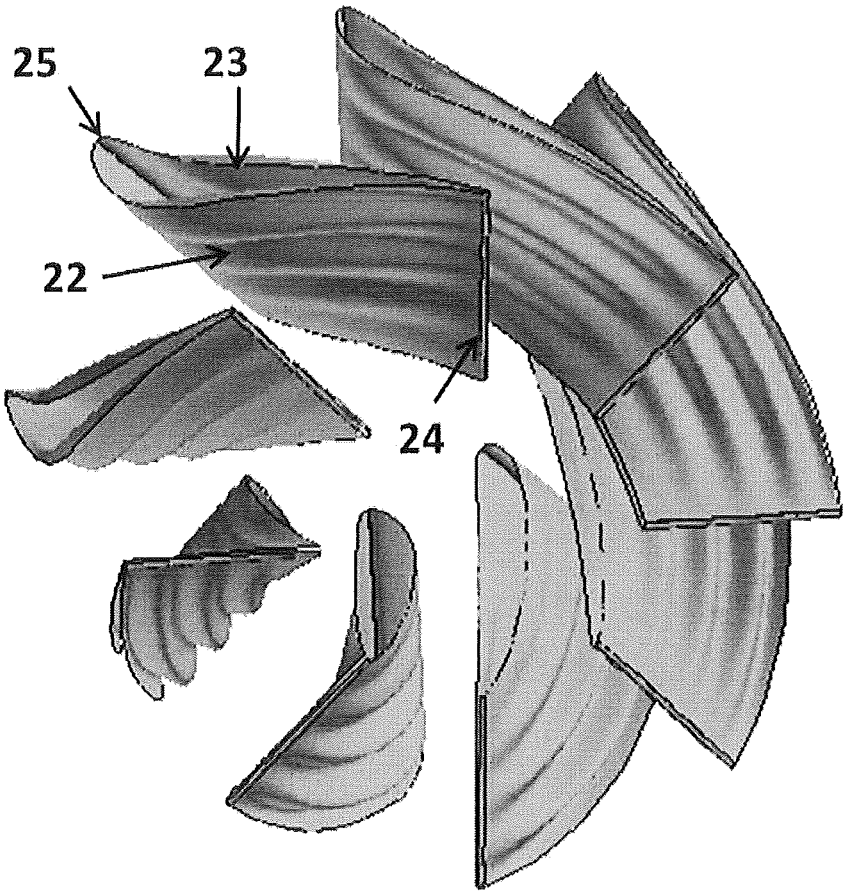
FIG. 10 shows schematic perspective view of an axial swirler according to embodiment of the invention.
Figure 11A:
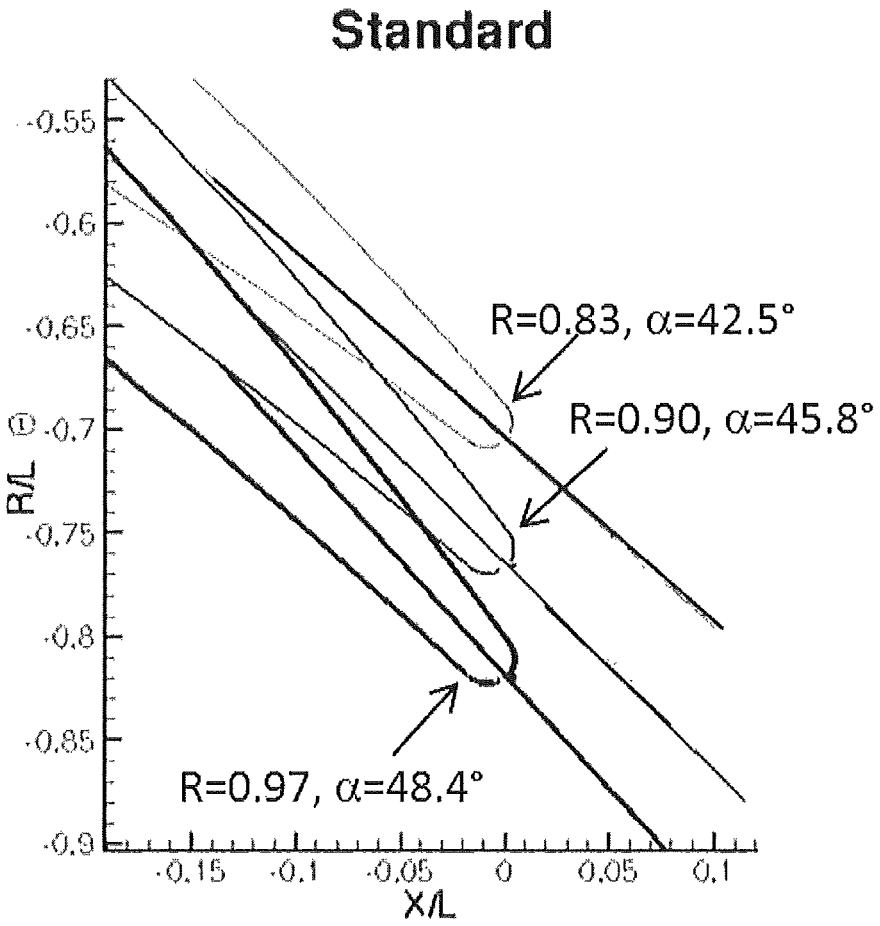
FIG. 11 shows trailing edge at three different values of the radius and exit flow angle for a) standard, b) lobed and c) swirler according to the invention.
Figure 11B:
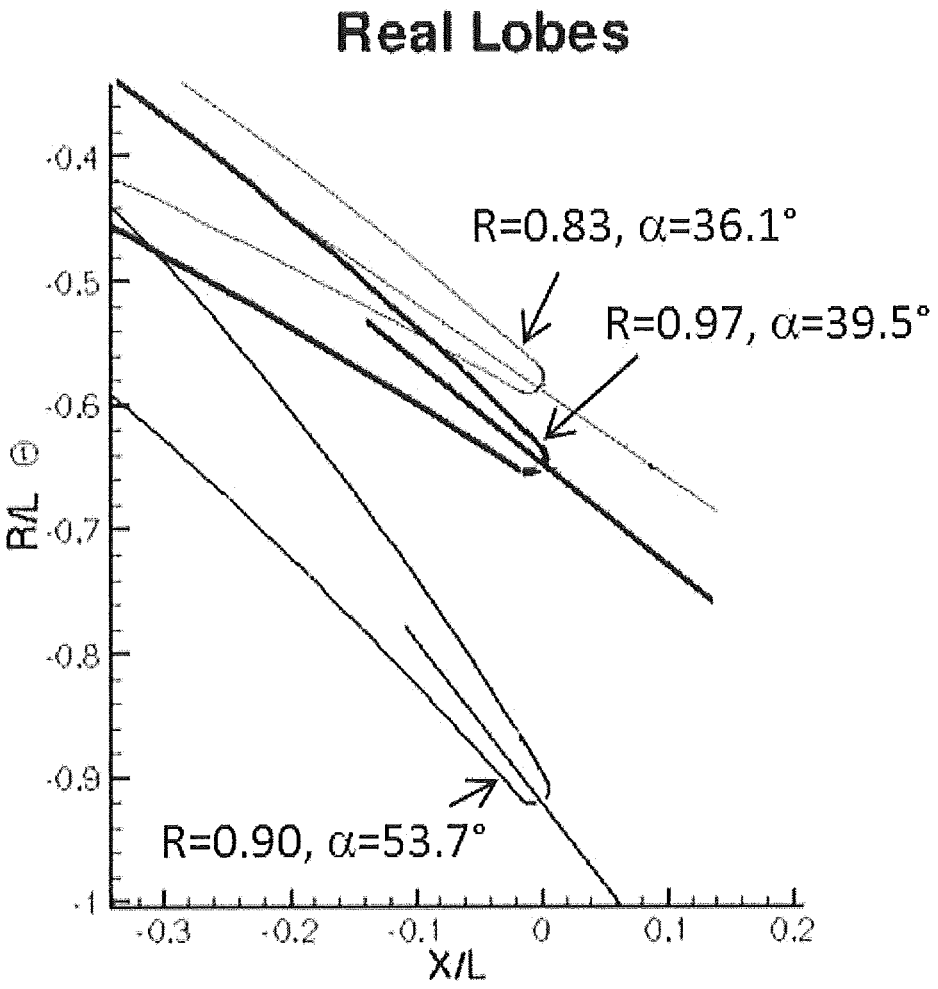
Figure 11C:
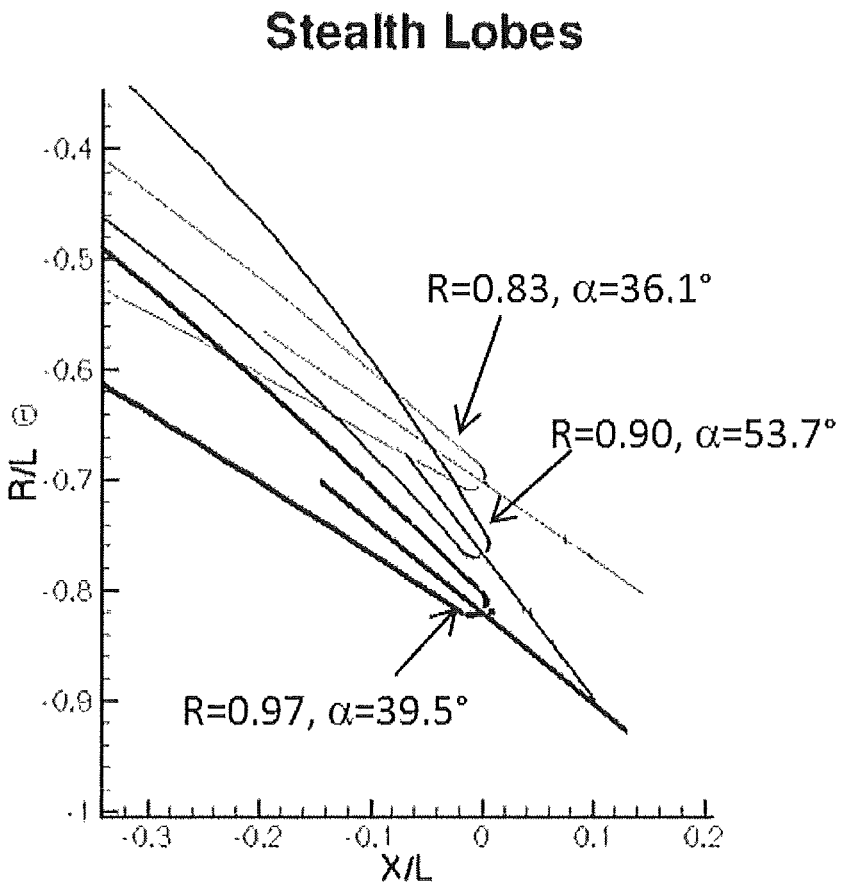

The necessary distribution of the position of the maximum camber C which gives a straight trailing edge is shown from the swirler map of FIG. 9. This is the thick dashed line of Ω/L=32° (FIG. 9) which implies a periodic fluctuation in position of maximum camber C, counterbalancing the lobed shape of the trailing edge. The axial swirler obtained by the selection of this maximum camber line distribution is shown in FIG. 10. This swirler displays a trailing edge which is straight and has the same discharge flow characteristics of the lobed axial swirler. In order to have a more clear explanation, the airfoils at three different radial locations for a) standard, b) lobed and c) swirler according to the invention are shown in FIG. 11. The figure shows the monotonic azimuthal displacement of the trailing edge, in case of standard and swirler according to the invention (as expected in case of a straight trailing edge) and the non-monotonic displacement in case of lobed swirler. The variation of angle α is however monotonic only in case of standard swirler, as required by the target distribution.

Figure 12A:
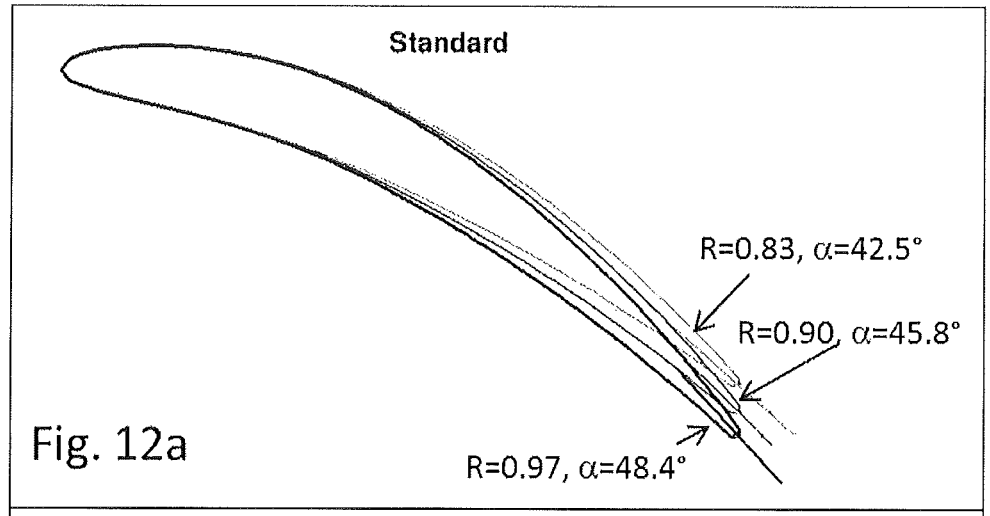
FIG. 12 shows complete airfoils in case of the three types of swirler: a) standard, b) lobed and c) swirler according to the invention, for three different radial sections.
Figure 12B:
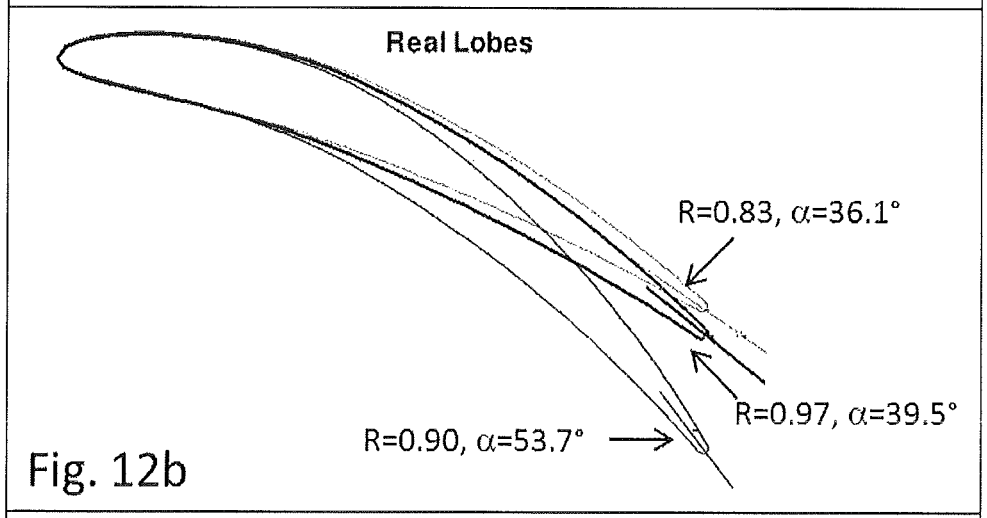
Figure 12C:
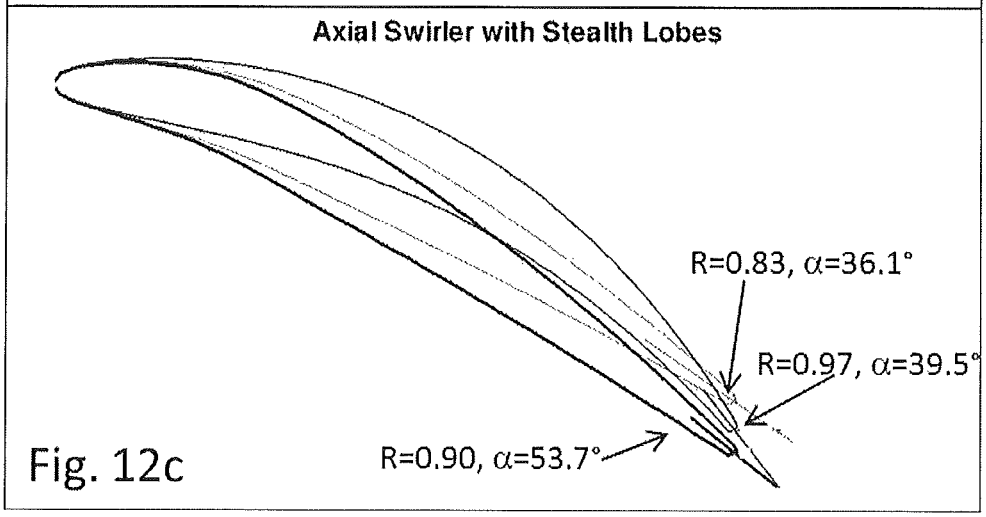
Figures 13A, 13B, 13C:
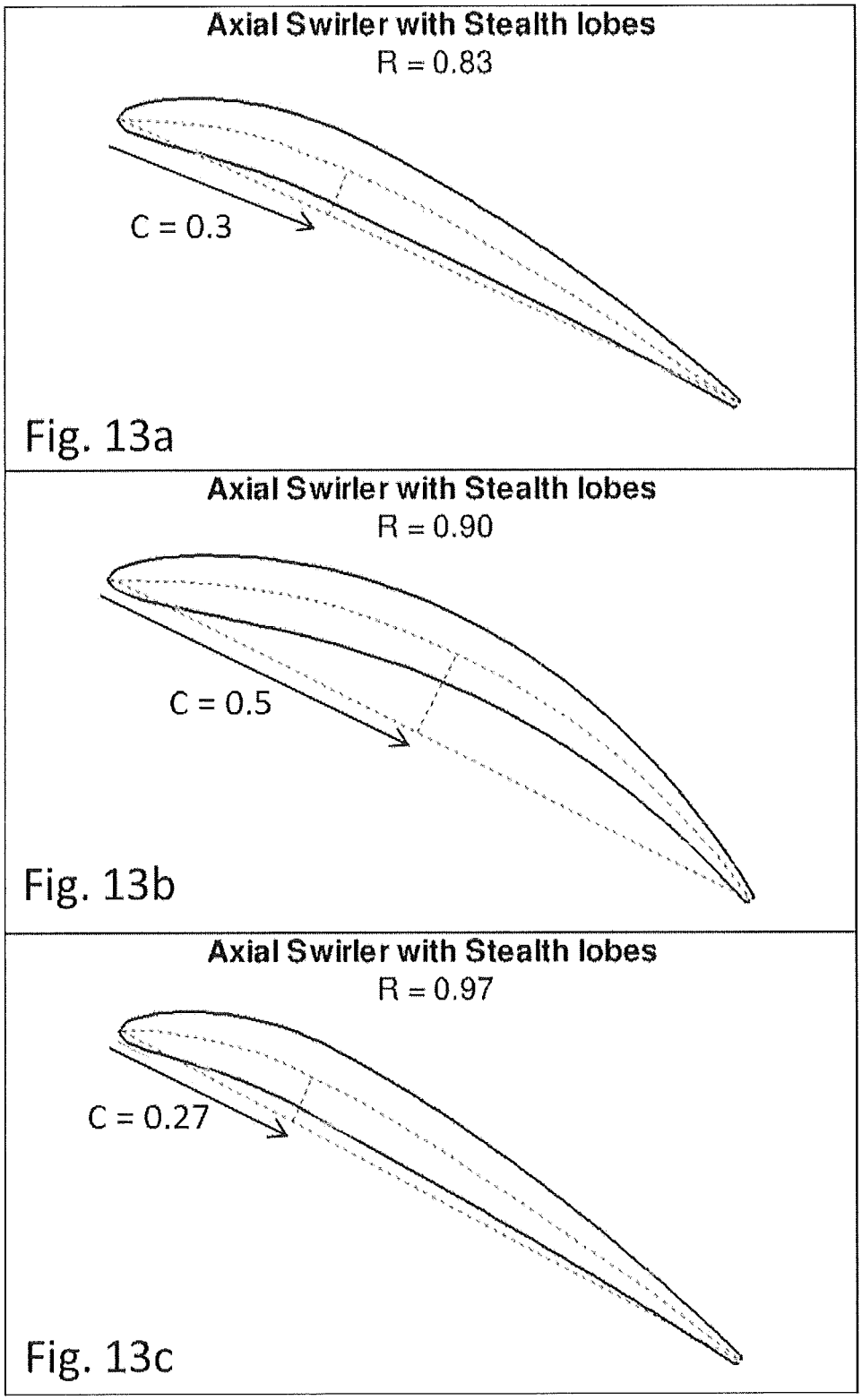
FIG. 13 shows, for the swirler according to the invention, the non-monotonic change of maximum camber position for increasing radius necessary to keep the trailing edge along a straight line

FIG. 12 shows the complete airfoils at the three different radial locations. The figure shows that the position of maximum camber is approximately constant and equal to 0.4 in case of the standard and lobed swirlers while it moves non-monotonically in case of the swirler according to the invention. This characteristic for the axial swirler according to the invention is shown in details in FIG. 11.

Above described embodiment shows an example where a discharge flow angle α between a tangent 26 to the swirl vane camber line 27 at its trailing edge 24 and the swirler axis 47 is sinusoidal function of a radial distance R from the swirler axis 47, and a position of maximum camber C 21 of the swirl vane is also sinusoidal function of a radial distance R from the swirler axis 47. This type of the function (sinusoidal) is not limiting. The invention covers any case wherein for at least one swirl vane 3 said first and second functions comprise each a respective local maximum and local minimum values along said radial distance from $R_{min}$ to $R_{max}$. Local maximum and local minimum are generally defined as follows:

Definition of a local maxima: A function f(x) has a local maximum at $x_0$ if and only if there exists some interval I containing $x_0$ such that $f(x_0)>=f(x)$ for all x in I.

Definition of a local minima: A function f(x) has a local minimum at $x_0$ if and only if there exists some interval I containing $x_0$ such that $f(x_0)<=f(x)$ for all x in I.

The first derivative of function at local maximum or minimum is zero.

Other non-limiting examples of combinations for discharge flow angle α between a tangent 26 to the swirl vane camber line 27 at its trailing edge 24 and the swirler axis 47, and a position of maximum camber C 21 of the swirl vane as function of a radial distance R from the swirler axis 47 are presented in the dependent claims.

The burner comprising an axial swirler as described above is characterized in that at least one of the swirl vanes is configured as an injection device with at least one fuel nozzle for introducing at least one fuel into the burner.

The burner can comprise one swirler or a plurality of swirlers. A burner with one swirler typically has a circular cross section. A burner comprising a plurality of swirlers can have any cross-section but is typically circular or rectangular. Typically a plurality of burners is arranged coaxially around the axis of a gas turbine. The burner cross-section is defined by a limiting wall, which for example forms a can-like burner.

In one embodiment the burner under full load injects fuel from the suction side or the pressure side of at least one, preferable of all swirl vanes.

In a particularly preferred embodiment, the fuel is injected on the suction side and the pressure side of each swirler vane, i.e. from both sides of the injecting swirl vane simultaneously.

Figure 14A:
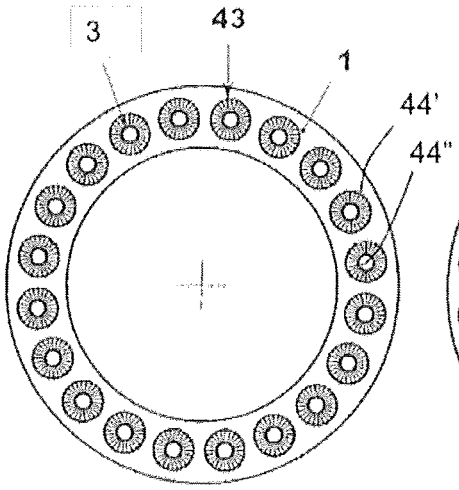
FIG. 14 shows according to the embodiments of the invention: a) an example of an annular combustor with burners comprising one swirler per burner as well as in b) an example of an annular combustor with a burners comprising five swirlers per burner.
Figure 14B:
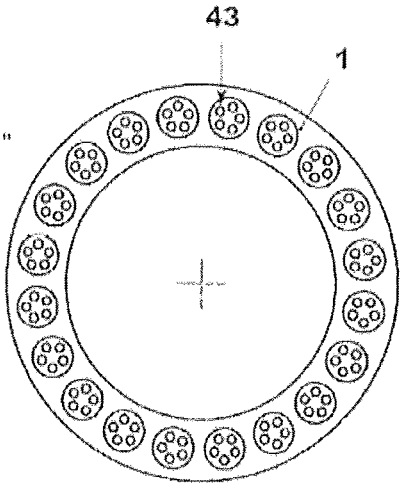

FIG. 14 shows according to the embodiments of the invention: a) an example of an annular combustor with burners comprising one swirler per burner as well as in b) an example of an annular combustor with burners comprising five swirlers per burner.

Figure 15A:
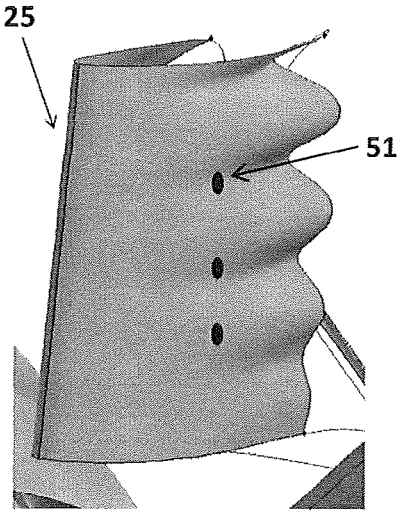
FIG. 15 shows injection of fuel from a) suction and b) pressure side of the swirler blade according to one embodiment of the invention.
Figure 15B:
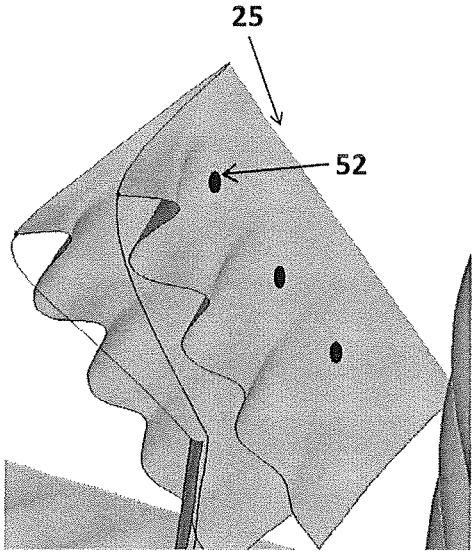

FIG. 15 shows injection of fuel from suction and pressure side of the swirler blade according to one embodiment of the invention.

The invention claimed is:

1. A swirler for a gas turbine burner comprising:

an axial swirler having a plurality of swirl vanes, each swirl vane of the plurality of swirl vanes having a streamline cross-section and being arranged around a swirler axis and extending in a respective radial direction between an inner radius ($R_{min}$) and an outer radius ($R_{ma}$x), each swirl vane of the plurality of swirl vanes having a respective leading edge, a respective trailing edge, a respective suction side and a respective pressure side, wherein each suction side and each pressure side extends between said respective leading edge and said respective trailing edge, wherein a respective discharge flow angle ($\alpha$) between a respective tangent to a respective swirl vane camber line at the respective trailing edge of each swirl vane of the plurality of swirl vanes and the swirler axis is a respective first function of a respective radial distance (R) from the swirler axis, and a respective position of maximum camber of each swirl vane of the plurality of swirl vanes is a respective second function of the respective radial distance (R) from the swirler axis, wherein the trailing edge of each swirl vane of the plurality of swirl vanes is straight; and wherein for at least one swirl vane of the plurality of swirl vanes, said respective first function and second respective function are both non-monotonic and include a respective local maximum value and a respective local minimum value along said respective radial distance from $R_{min}$ to $R_{max}$.

2. The axial swirler according to claim 1, wherein for said at least one swirl vane, said first respective function, and/or said respective second function is a periodic function.

3. The swirler according to claim 1, wherein for said at least one swirl vane, a period of said respective first function, and/or of said second respective function is from 1 to 100 mm.

4. The swirler according to claim 1, wherein for said at least one swirl vane, said first respective function, and/or said second respective function is a sinusoidal function.

5. The swirler according to claim 1, wherein for said at least one swirl vane, said respective first function, and said second respective function are in phase from $R_{min}$ to $R_{max}$.

6. The swirler according to claim 1, wherein for said at least one swirl vane, said respective first function is given by a function: $a_0+R^b a^* \sin(2\pi NR)$ where $a_0$ is a fixed angle, a* is a maximum angle deviation, and b and N are rational numbers.

7. The swirler according to claim 1, wherein all the swirl vanes of the plurality of swirl vanes are identically formed, and/or the plurality of swirl vanes are arranged around the swirler axis in a circle.

8. The swirler according to claim 1, wherein the respective first function of two adjacent swirl vanes plurality of swirl vanes are in phase or are inverted out of phase.

9. A burner for a combustion chamber of a gas turbine, the burner comprising:

the swirler according to claim 1.

10. The burner according to claim 9, comprising:

a fuel injector.

11. The burner according to claim 9, wherein one or more swirl vanes of the plurality of swirl vanes are configured as an injection device with at least one fuel nozzle for introducing at least one fuel into the burner.

12. The burner according to claim 10, wherein the fuel injector is arranged to inject fuel on the suction side of one or more swirl vanes.

13. The burner according to claim 10, wherein the fuel injector is arranged to inject fuel on the pressure side of one or more swirl vanes.

14. The swirler according to claim 1, wherein for said at least one swirl vane, a period of said respective first function, and/or of said respective second function is in a range of 20-60 mm.

15. A swirler for a gas turbine burner comprising:

an axial swirler having a plurality of swirl vanes, each swirl vane of the plurality of swirl vanes having a streamline cross-section and being arranged around a swirler axis and extending in a respective radial direction between an inner radius ($R_{min}$) and an outer radius ($R_{ma}$x), each swirl vane of the plurality of swirl vanes having a respective leading edge, a respective trailing edge, a respective suction side and a respective pressure side, wherein each suction side and each pressure side extends between said respective leading edge and said respective trailing edge, wherein a respective discharge flow angle ($\alpha$) between a respective tangent to a respective swirl vane camber line at the respective trailing edge of each swirl vane of the plurality of swirl vanes and the swirler axis is a first function of a respective radial distance (R) from the swirler axis, and a respective position of maximum camber of each swirl vane of the plurality of swirl vanes is a second function of the respective radial distance (R) from the swirler axis, wherein the trailing edge of each swirl vane of the plurality of swirl vanes is straight; and wherein for the each swirl vane of the plurality of swirl vanes, said first function and second function are both nonmonotonic and each include a respective local maximum value and a local minimum value along said radial distance from $R_{min}$ to $R_{max}$.

16. The axial swirler according to claim 15, wherein said first function, and/or said second function is a periodic function.

17. The axial swirler according to claim 15, wherein said first function, and/or said second function is a sinusoidal function.

18. The axial swirler according to claim 15, wherein said first function, and said second function are in phase from $R_{min}$ to $R_{max}$.

19. A burner for a combustion chamber of a gas turbine, the burner comprising:

the swirler according to claim 15.

20. The burner according to claim 19:

wherein at least one of the swirl vanes of the plurality of swirl vanes is configured as an injection device with at least one fuel nozzle for introducing at least one fuel into the burner.

* * * * *